United States Patent [19]

Hartman

[11] Patent Number: 5,060,902

[45] Date of Patent: Oct. 29, 1991

[54] CORNER PROTECTOR

[76] Inventor: Brian T. Hartman, Storgt 15, 1446 Drobak, Norway

[21] Appl. No.: 550,064

[22] Filed: Jul. 9, 1990

[51] Int. Cl.[5] ..... A47B 95/00

[52] U.S. Cl. ..... 248/345.1; 108/27

[58] Field of Search ..... 248/345.1; 108/27; 150/198; 446/226, 72, 184

[56] References Cited

U.S. PATENT DOCUMENTS

| | | | |
|---|---|---|---|
| 2,838,872 | 6/1958 | Beck | 446/226 |
| 2,975,550 | 3/1961 | Miller | 446/184 X |
| 3,089,276 | 5/1963 | Brooks | 248/345.1 |
| 4,117,782 | 10/1978 | Cahill | 108/27 |
| 4,807,936 | 2/1989 | Behrendt | 248/345.1 |
| 4,817,902 | 4/1989 | Mason | 248/345.1 |

*Primary Examiner*—David L. Talbott
*Attorney, Agent, or Firm*—Leon Gilden

[57] ABSTRACT

A corner protector assembly for overlying and encompassing a corner portion of associated furniture, wherein the corner protector includes an inflatable body that further includes an overlying head and spaced upper limbs and spaced lower limbs, wherein the spaced upper limbs include fastener members mounted to engage the furniture, as well as one lower limb including a set of lower fasteners for securement to the furniture. The fasteners may include mechanical as well as adhesive association to the furniture. An audible valve is provided within a forward end of the head portion to effect an audible enunciation upon impact with the inflatable body.

1 Claim, 5 Drawing Sheets

FIG. 7

PRIOR ART

CORNER PROTECTOR

BACKGROUND OF THE INVENTION

1. Field of the Invention

The field of invention relates to safety devices, and more particularly pertains to a new and improved corner protector for securement to corner portions of associated furniture to minimize injury to infants and the like in inadvertent impact with such furniture.

2. Description of the Prior Art

Infants, and particularly toddlers, are subject to injury upon undesirable and accidental impact with corner portions of associated furniture. Such impact occurs with vamping degrees of damage to a small child, wherein such children are particularly susceptible to head injuries, wherein the instant invention attempts to overcome deficiencies of the prior art by providing an inflatable bladder member that is easily mounted to associated furniture and additionally providing such organization aesthetically appealing to children as well as adults to psychologically assist such individuals in permitting continuous association of the corner protector of the instant invention with associated furniture. Prior art corner protector devices are available, but have heretofore lacked the security of a fixed mounting, as well as the impact absorbing construction of the instant invention. Such Prior art may be found in U.S. Pat. No. 4,072,231 to Helms wherein a corner protector is of a molded construction to overlie a corner portion of an associated furniture member.

U.S. Pat. No. 4,817,902 to Mason utilizes a corner protector with hook and loop fastener straps to secure the organization to an associated furniture member.

U.S. Pat. No. 4,192,423 to Rekow sets forth a corner pad that is inter-folded to overlie a corner portion of a furniture structure.

U.S. Pat. No. 3,762,626 to Dorsey sets forth a molded pulp protector adapted for overlying furniture portions during shipping of such furniture within associated cartons.

U.S. Pat. No. 4,240,225 to Sartain sets forth a corner protector for furniture held in place by mechanical means such as screws or adhesive material.

As such, it may be appreciated that there is a continuing need for a new and improved corner protector wherein the same addresses both the problems of ease of use, as well as effectiveness in construction and in this respect, the present invention substantially fulfills this need.

SUMMARY OF THE INVENTION

In view of the foregoing disadvantages inherent in the known types of corner protector now present in the prior art, the present invention provides a corner protector wherein the same utilizes an inflatable bladder mounted to a furniture corner portion, wherein the corner protector of the instant invention is longitudinally aligned to extend below the furniture portion with additional securement means to mount and align the longitudinal body relative to the furniture. As such, the general purpose to the present invention, which will be described subsequently in greater detail, is to provide a new and improved corner protector which has all the advantages of the prior art corner protectors and none of the disadvantages.

To attain this, the present invention provides a corner protector assemble for overlying and encompassed a corner portion of associated furniture, wherein the corner protector includes an inflatable body that further includes an overlying head and spaced upper limbs and spaced lower limbs, wherein the spaced upper limbs include fastener members mounted to engage the furniture, as well as one lower limb including a set of lower fasteners for securement to the furniture. The fasteners may include mechanical as well as adhesive association to the furniture. An audible valve is provided within a forward end of the head portion to effect an audible enunciation upon impact with the inflatable body.

My invention resides not in any one of these features per se, but rather in the particular combination of all of them herein disclosed and claimed and it is distinguished from the prior art in this Particular combination of all of its structures for the functions specified.

There has thus been outlined, rather broadly, the more impotent features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner protector which has all the advantages of the prior art corner protectors and none of the disadvantages.

It is another object of the present invention to provide a new and improved corner protector which may be easily and efficiently manufactured and marketed.

It is a further object of the present invention to provide a new and improved corner protector which is of a durable and reliable construction.

An even further object of the present invention is to provide a new and improved corner protector which is susceptible of a low cost of manufacture with regard to both materials and labor, and which accordingly is then susceptible of low prices of sale to the consuming public, thereby making such corner protector economically available to the buying public.

Still yet another object of the present invention is to provide a new and improved corner protector which provides in the apparatuses and methods of the prior art some of the advantages thereof, while simultaneously overcoming some of the disadvantages normally associated therewith.

Still another object of the present invention is to provide a new and improved corner protector wherein the same provides an elongate cushioned bladder securable to an upper surface, as well as an underlying surface of associated furniture to permit securement of the corner protector to the furniture.

These together with other objects of the invention, along with the various features of novelty which characterize the invention, are pointed out with particularity in the claims annexed to and forming a part of this disclosure. For a better understanding of the invention, its operation advantages and the specific objects attained by its uses, reference should be had to the accompanied drawing and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
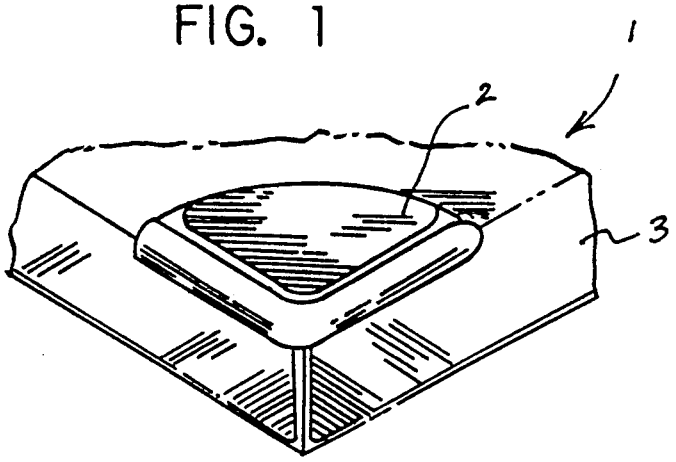
FIG. 1 is an isometric illustration of a prior art corner protector.

With reference now to the drawings, and in particular to FIGS. 1 to 9 thereof, a new and improved corner protector embodying the principles and concepts of the present invention and generally designated by the reference numeral 10 will be described.

Figure 2:
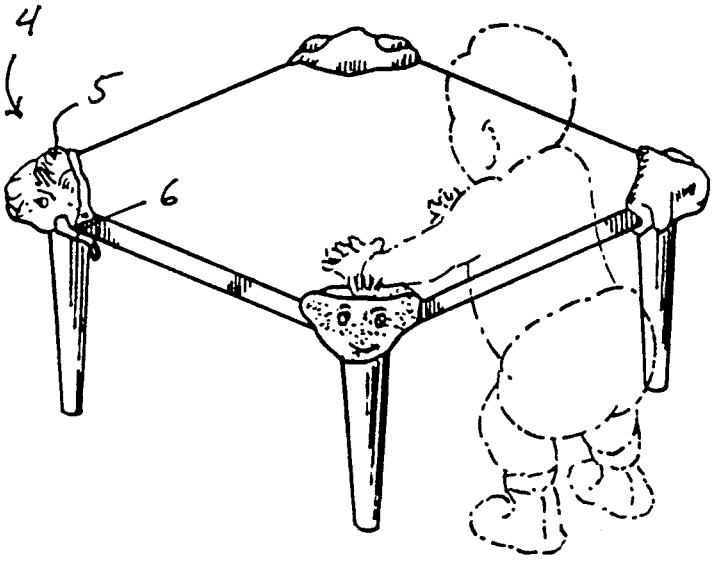
PRIOR ART FIG. 2
FIG. 2 is an isometric illustration of a further prior art corner protector organization.

FIG. 1 illustrates a prior art corner protector 1, wherein the molded protector 2 is fixedly mounted to a corner portion of a table 3. FIG. 2 illustrates a further prior art corner protector organization 4, wherein the corner protectors 5 include strap members 6 formed with hook and loop fasteners to releasably secure the corner protectors to the associated table structure.

Figure 3:
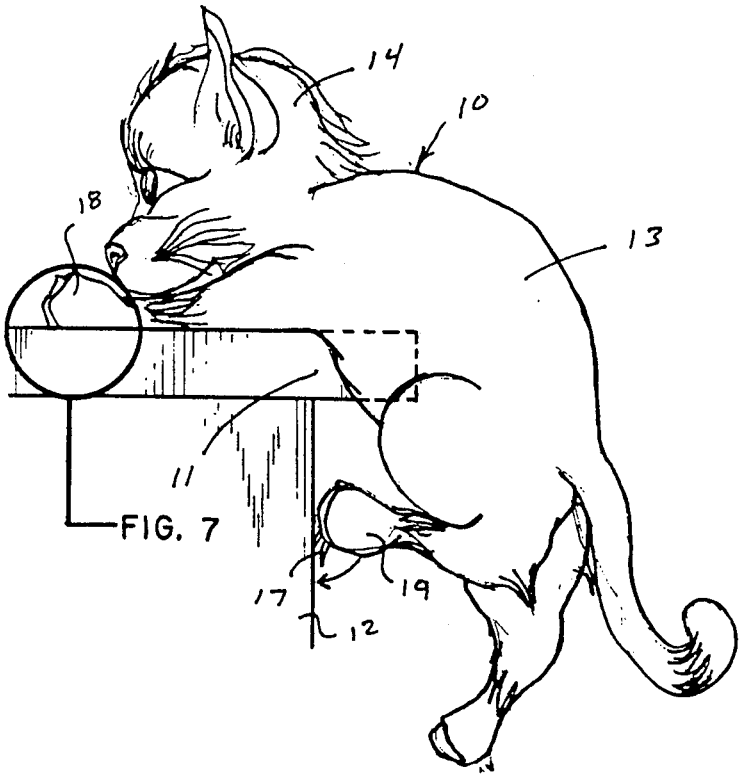
FIG. 3 is an orthographic side view, taken in elevation, of the instant invention.
Figure 4:
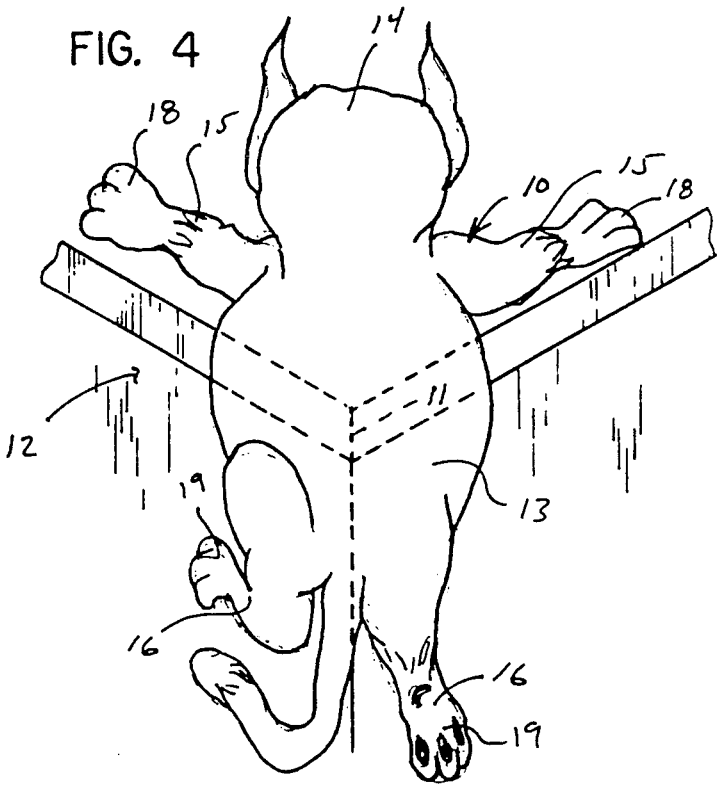
FIG. 4 is an orthographic rear view, taken in elevation, of the instant invention.
Figure 5:
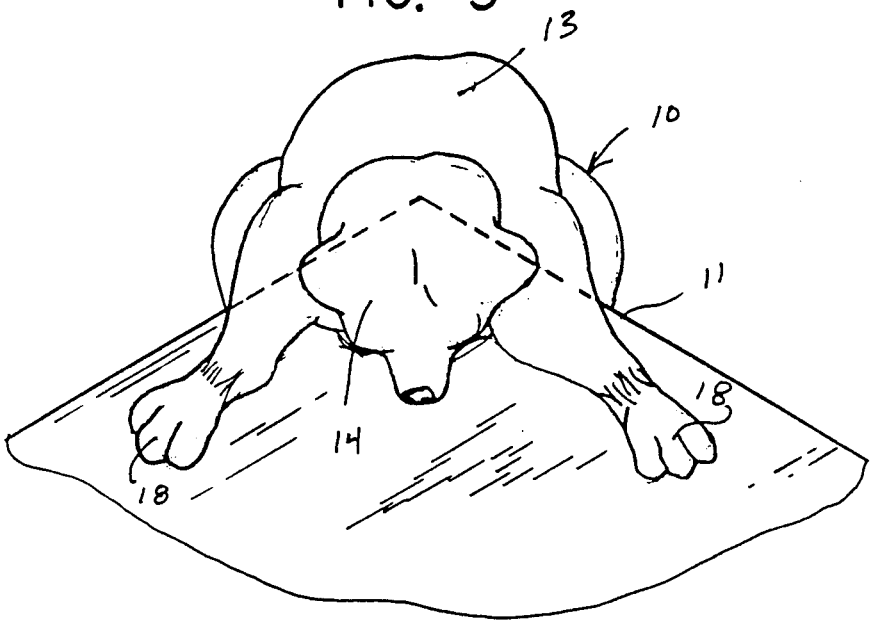
FIG. 5 is an isometric illustration of the instant invention overlying a corner portion of a furniture member.
Figure 6:
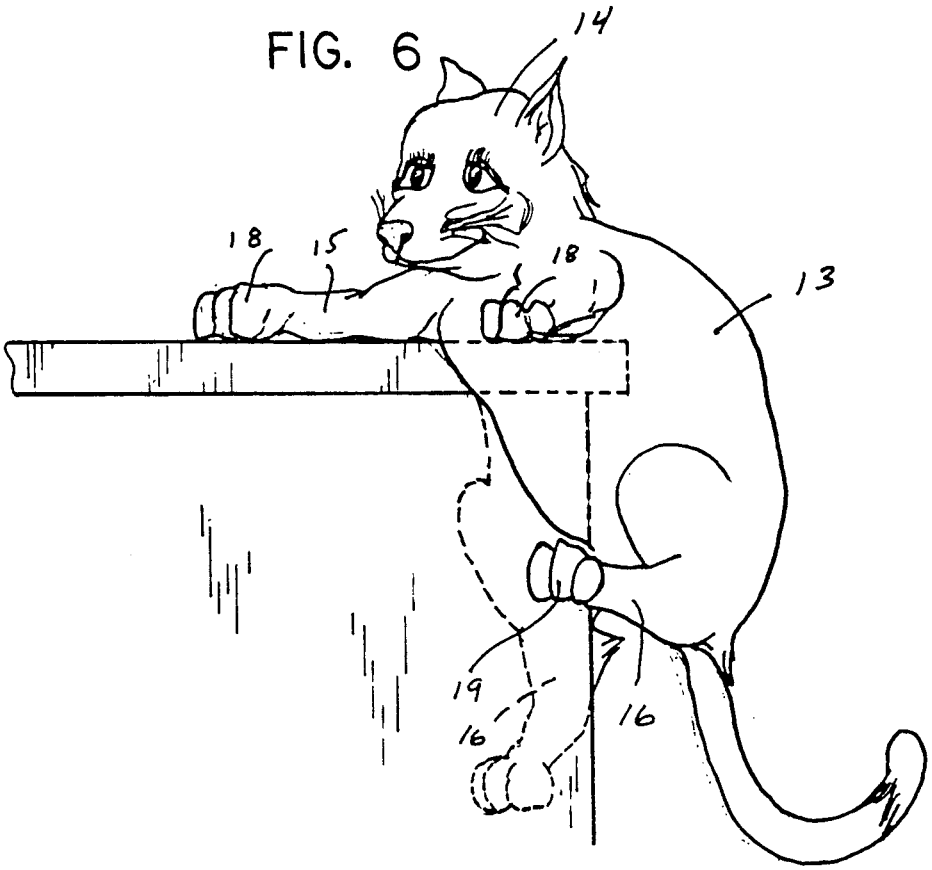
FIG. 6 is a frontal isometric illustration of the organization mounted to a furniture member.
Figure 7:
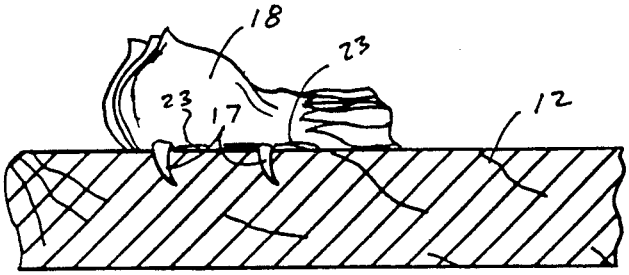
FIG. 7 is an orthographic view, somewhat enlarged, of section 7 as set forth in FIG. 3.
Figure 8:
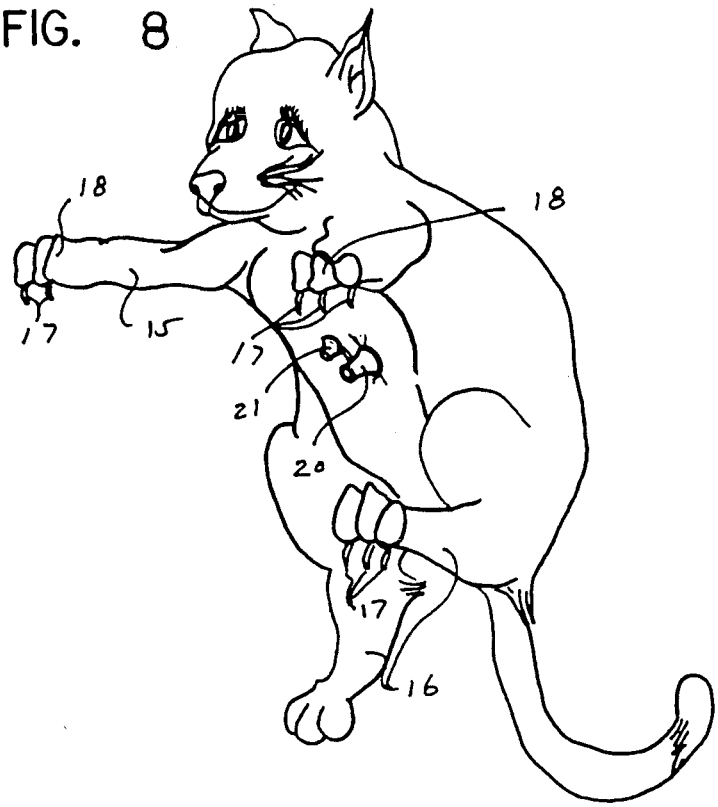
FIG. 8 is an isometric illustration of the instant invention.

More specifically, the corner protector 10 of the instant invention essentially includes mounting to a corner portion 11 of associated furniture 12. The corner protector 10 is defined as an elongate longitudinally aligned inflatable bladder defined by a body portion 13, an upwardly oriented head portion 14 to overlie the corner portion 11, with a lower portion of the body 13 directed below the corner portion 11. The body portion 13 includes a plurality of upper leg members 15 directed forwardly and overlying the corner portion 11 of the furniture 12, with a plurality of lower leg members 16 positioned below the corner portion. The leg members each include respective upper foot portions 18 defining free terminal ends of the upper leg members 15, with lower foot portions 19 defining free terminal ends of the lower leg members 16. The upper foot portions 18 include mechanical fasteners defined as arcuate securement fasteners 17 to simulate claws that are directed into the furniture to effect mechanical attachment thereto, wherein alteratively (see FIG. 7) an adhesive payer 23 is provided to adherably mount each of the foot portions 18 to an upper surface of the table defining the corner portions 11. The lower foot portions 18 include at least one foot portion, as illustrated in FIG. 3 and FIG. 8 for example, to include the mechanical arcuate securement fastener 17, as well as an alternative use of an adhesive layer to effect securement of at least one lower foot portion 18 onto the furniture to align and position the elongate body portion 13 to overlie the corner portion or projection 11 of the associated furniture 12.

An inflation valve 20 is formed through a forward surface of the body portion 13 that includes a removable cap 21 to permit manual or mechanical inflation of the body portion 13. This further permits selective pressurizing of the body portion to a predetermined firmness relative to each corner portion 11.

Figure 9:
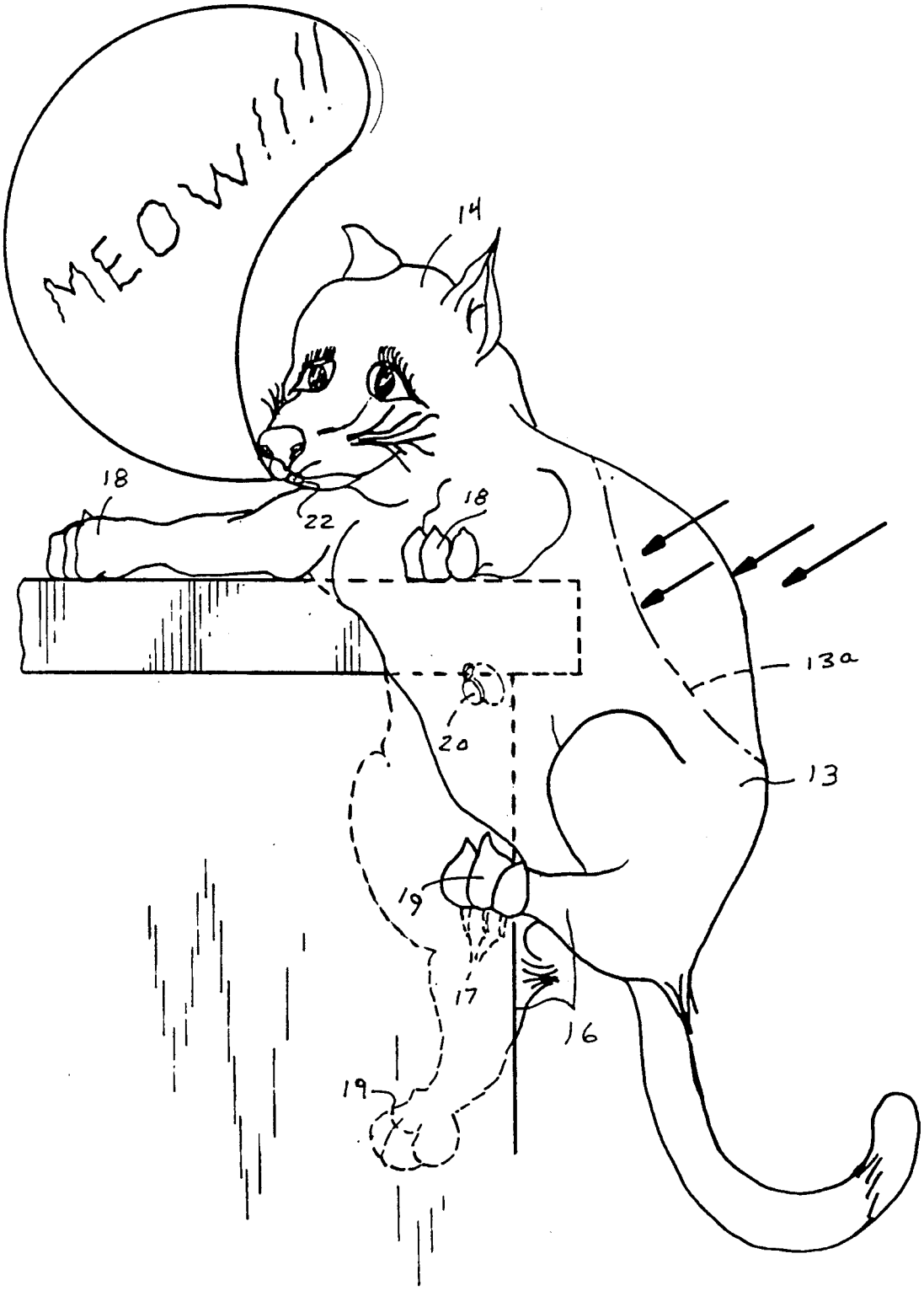
FIG. 9 is an isometric illustration of the instant invention illustrating deformation of the body portion of the invention in association with an audible valve mounted in the head portion of the body member.

FIG. 9 illustrates the head portion 14 formed with an audible valve 22 positioned at a forward terminal extremity of the head portion 14 aligned with a simulated mouth of the simulation of the animal-like organization defined by the corner protector 10. The audible valve 22 effects an audible sound upon displacement of the body portion 13 to a displaced body contour 13*a*, as illustrated in phantom in FIG. 9.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A corner protector for overlying a corner portion of a structure comprising, in combination, an elongate longitudinally aligned body portion, the body portion including a head portion mounted to an upper end of the body portion, and the body portion including a plurality of upper leg members for securement to an upper portion of the structure, and including a plurality of lower leg members, wherein the lower leg members are formed to a lower terminal end of the body portion and the upper leg members are formed to an upper end of the body portion adjacent the head portion, and each upper leg member including an upper foot portion, and each upper foot portion including a plurality of securement fasteners to secure each upper foot portion to the structure, and wherein at least one of the plurality of lower foot portions including a a plurality of securement fasteners to secure a lower foot portion to the structure, and wherein the body portion, head portion, upper leg members, and the lower leg members define an inflatable bladder, and the body portion including a forward surface and a rear surface, and the forward surface including an inflation valve mounted through the forward portion to effect inflation of the inflatable bladder to a selective pressure, and wherein the securement fasteners include rigid fastener elements to project interiorly of the structure to secure the leg members to the structure, and wherein each upper foot portion and at least one of the lower foot portions includes an adhesive layer to secure the upper foot portions and the lower foot portion to the structure, and wherein the head portion includes a forward terminal head portion end, and the forward terminal head portion end includes an audible valve to effect an audible sounding upon deflection and displacement of the body portion upon impact of the body portion.

* * * * *